United States Patent [19]

Howie

[11] Patent Number: 4,876,746

[45] Date of Patent: Oct. 31, 1989

[54] ENVIRONMENTAL PROTECTIVE GARMENT

[75] Inventor: Robin M. Howie, Edinburgh, Scotland

[73] Assignee: Coal Industry (Patents) Limited, United Kingdom

[21] Appl. No.: 164,918

[22] Filed: Mar. 7, 1988

[30] Foreign Application Priority Data

Mar. 6, 1987 [GB] United Kingdom ..... 8705263

[51] Int. Cl.[4] ..... A41D 13/00

[52] U.S. Cl. ..... 2/69; 2/81

[58] Field of Search ..... 2/69, 69.5, 81

[56] References Cited

U.S. PATENT DOCUMENTS

| | | | |
|---|---|---|---|
| 3,096,702 | 7/1963 | Malone, Sr. et al. | 2/81 X |
| 3,468,299 | 9/1969 | D'Amato | 2/81 X |
| 3,610,251 | 10/1971 | Sanderson | 2/69.5 X |
| 4,230,114 | 10/1980 | Feather | 2/69 X |
| 4,741,333 | 5/1988 | Suzuki et al. | 2/69.5 X |

FOREIGN PATENT DOCUMENTS

| | | |
|---|---|---|
| 0117303 | 9/1984 | European Pat. Off. . |
| 1208284 | 10/1970 | United Kingdom . |
| 1395099 | 5/1975 | United Kingdom . |
| 2101469 | 1/1983 | United Kingdom . |
| 2105971 | 4/1983 | United Kingdom . |
| 2151457 | 7/1985 | United Kingdom . |

*Primary Examiner*—H. Hampton Hunter

*Attorney, Agent, or Firm*—Stevens, Davis, Miller & Mosher

[57] ABSTRACT

An environmental protective garment, especially for use in "clean rooms", is an at least partly air resistant garment having suitable body seals and an air mover means for providing a negative pressure within the garment when worn. The exhausted air from the air mover means may be passed through a scrubber or filter. Greater wearer comfort is possible than with known suits.

5 Claims, 1 Drawing Sheet

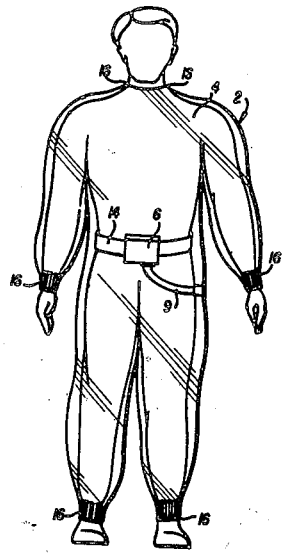

ENVIRONMENTAL PROTECTIVE GARMENT

This invention concerns an environmental protective garment, more especially a garment of the ventilated suit type.

Protective clothing is widely used to prevent contamination of an environment such as in medicine or in "clean rooms", by organisms or materials released from the wearer's body. The performance of existing protective clothing for such use is limited by air penetration of the fabric, seams and fasteners or by leakage past seals between the clothing and the wearer's body. Attempts to control the egress of organisms or materials by these mechanisms is limited by the requirement to lose body heat generated by metabolic processes. A minor heat loss restriction will cause wearer discomfort which may affect work efficiency. If, however, there is a major restriction on the loss of body heat, excessive sweating and/or acute health hazards due to thermal stress may result.

The present invention provides an at least partly air resistant garment, preferably having one or more designated air flow routes, and comprising means for providing a suitable seal around parts of the body extending beyond the garment, and air mover means for providing a negative pressure, with respect to ambient, within the suit when worn. Desirably, the air mover means provides sufficient air flow to provide adequate loss of body heat, to improve comfort and to minimise the thermal stress potential. The designated air flow routes may comprise apertures, which may be in some embodiments the suit "seal", desirably screened or filtered to prevent significant opportunity for contaminents to reach the environment, and wall means to define air flow channels connecting with the air mover means.

The garment may be connected by a flexible hose to a remote air mover means, which may be within or outside the walls defining the clean environment. Alternatively, the air mover means may be mounted on the garment or carried on a harness, e.g. as a back pack. The exhaust from the air mover means, if it is vented to a clean environment, may be passed through one or more filters or scrubbers adequate to remove contaminents from the exhausted air. If the air from the garment is taken outside the clean environment, either because the air mover is in the environment but exhausted air is contained by a hose or duct connected to the outside, or the air mover is outside the environment, a filter or scrubber is not essential, but may still be preferred. Depending upon the application, the garment material, or a portion thereof, may form a filter for exhausted air. The choice of filter, its efficiency, or the use of a scrubber eg for gases, may be made according to the particular environment and general conditions.

There are available small electric fans capable of moving c150 l/min of air while requiring only small amounts of electric power such as may be provided by a battery pack, for example a rechargeable battery pack which may be carried by the wearer. It is preferred to use such a fan and battery pack for the air move, together with an environmental protective filter connected to the exhaust from the fan.

FIGS. 1 and 2 illustrate the invention in which:

FIG. 1 is an elevational view, shown schematically, of a person wearing a garment according to this invention; and FIG. 2 is a schematic view of the belt-mounted air mover shown in FIG. 1.

Figure 1:
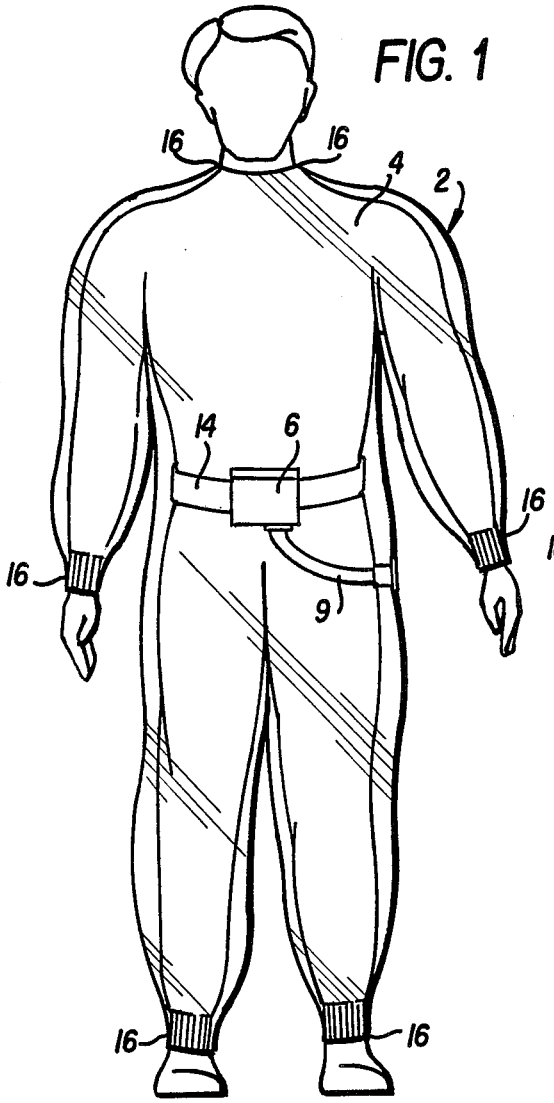

In FIG. 1 protective clothing 2 is worn on a wearer 4 with a belt-mounted unit 6 carried by a belt 14 around the wearer's waist. The unit 6 has an outlet 9 that passes air out to the environment. There are a plurality of air inlets 16 located at the ankles, wrists and neck as seen in FIG. 1.

Figure 2:
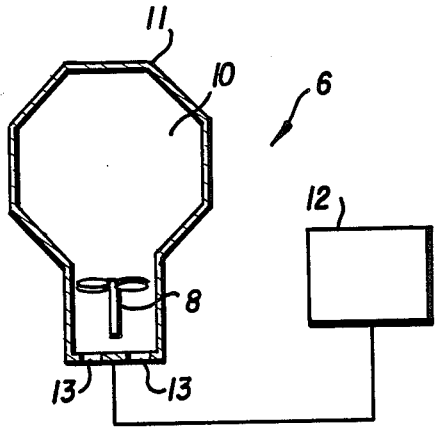

In FIG. 2 air 6 in the body-clothing volume is drawn thru filter 10 that may be capable of filtering gases and/or particulate matter. A fan/air 8 mover has an electrical motor driven by a battery pack 12. Unfiltered air may be drawn into fan inlet 13 and the filtered air passes out through outlet 11.

I claim:

1. An environmental protective garment for use in a dust free clean room to prevent dispersal of particulate matter from the body of the wearer but permitting the wearer to avoid excessive body heat buildup, said garment comprising a suit of partly air resistant material to cover substantially the entire body of the wearer and having a seal around parts of the wearer's body extending beyond the garment;

air mover means connected to said garment to draw air through said partly air resistant material so as to provide a negative pressure within said garment;

a filter or scrubber for gas connected to said garment downstream from the air mover means.

2. A garment according to claim 1, having at least one designated air flow routes when worn.

3. A garment according to claim 1, wherein the air mover means is mounted on the garment.

4. A garment according to claim 1, wherein the air mover means is mounted on a harness.

5. A garment according to claim 1, wherein the air mover means is remote from the garment and is linked thereto by a flexible hose.

* * * * *

UNITED STATES PATENT AND TRADEMARK OFFICE

CERTIFICATE OF CORRECTION

PATENT NO. : 4,876,746

DATED : October 31, 1989

INVENTOR(S) : Robin Middlemass HOWIE

Figure 3:
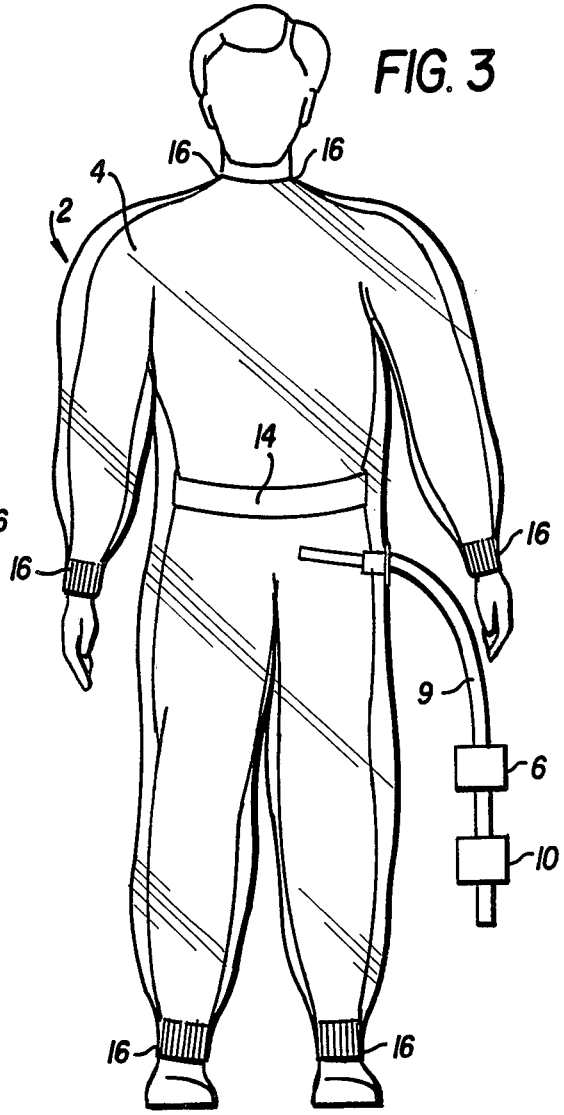

It is certified that error appears in the above-identified patent and that said Letters Patent is hereby corrected as shown below:

Column 2, after line 16, insert --FIG. 3 is similar to FIG. 1 but shows the air mover being remote rather than belt mounted.

Column 2, after line 28, insert --In FIG. 3 the air mover unit 6 is not carried on the wearer's belt but is remote from the wearer, being mounted on the exit conduit or some other convenient location.--

Signed and Sealed this

Second Day of April, 1991

*Attest:*

*Attesting Officer*

HARRY F. MANBECK, JR.

*Commissioner of Patents and Trademarks*